United States Patent [19]

Hull

[11] 4,008,837

[45] Feb. 22, 1977

[54] RUG NEEDLE

[75] Inventor: Susan A. Hull, Napa, Calif.

[73] Assignee: Lawrence Peska Associates, Inc., New York, N.Y. ; a part interest

[22] Filed: Mar. 10, 1976

[21] Appl. No.: 665,497

[52] U.S. Cl. ..... 223/102

[51] Int. Cl.² ..... D05B 85/00

[58] Field of Search ..... 223/10 V, 103, 104; 66/116, 117, 118, 119

[56] References Cited

UNITED STATES PATENTS

| | | | |
|---|---|---|---|
| 2,279,662 | 4/1942 | Denner | 223/102 |
| 2,530,851 | 11/1950 | Biggs | 66/118 |

*Primary Examiner*—George H. Krizmanich

[57] ABSTRACT

A rug needle includes an elongated shank- and holding-portion which is formed from a single length of rod or wire; one of the ends thereof is formed with a hook. The shank- and holding portion includes a first straight portion leading from the hook, a hand-gripping portion integral with the first portion terminating in a second straight portion, and a longitudinal saddle portion which substantially defines a second plane and terminates in a third, substantially straight portion. The latter is variably attachable to the second portion for the planes to subtend a selectable angle with one another.

8 Claims, 4 Drawing Figures

RUG NEEDLE

BACKGROUND OF THE INVENTION

1. FIELD OF THE INVENTION

The present invention relates to a needle for crocheting rugs or the like.

2. DESCRIPTION OF THE PRIOR ART

A needle of the above type, which is described in U.S. Patent 2,279,662 is restricted to use by right-handed people, and moreover does not permit any adjustment by the user for optimal comfort.

SUMMARY OF THE INVENTION

It is accordingly one of the objects of the present invention to provide a rug needle which is usable by both left- and right-handed persons, and which permits an adjustment for optimal comfort of the user.

I accordingly provide a rug needle which has an elongated shank- and holding-portion formed from a single length rod or wire, and which substantially defines a first plane. One of the ends of the needle is formed with a hook; the shank- and holding portion includes a first straight portion which leads from the hook, an open-ended handgripping portion which is integral with the first straight portion and which terminates in a second straight portion. A longitudinal saddle portion of the needle, which is designed to rest on the index finger of an operator terminates in a third substantially straight portion and substantially defines a second plane. The third straight portion is variably attachable to the second straight portion so that the planes can subtend an operator-selectable angle with one another. The saddle portion is disposed at a higher elevation than the shank- and holder portion upon attachment thereto, and has a length smaller than the length of the shank- and holding portion.

It is preferable if one of the second and third straight portions has a polygonal cross-section and if the other of the second and third straight portions is formed with a polygonally-shaped recess, so that the one of the second and third straight portions may be attached to the other of the second and third straight portions. One of the second and third straight portions has an end formed with a longitudinal slot, which is resiliently compressible upon attachment of the other of the second and third straight portions. At least the third straight portion is synthetic plastic material.

The open-ended looped portion is preferably positionable in the palm of the operator's hand. The part of the looped portion which is disposed opposite the third straight portion is bowed forwardly so as to be easily engageable by the operator's fingers and thus form a natural grip. The saddle portion is curved, and the planes intersect each other substantially along the third and second portions. The hook substantially defines a third plane which lies at right angles to the second plane.

The hook of the needle is disposed opposite the saddle portion and is designed to pierce material so that the latter can be moved onto the needle. The entire length of the needle is free and adapted to receive the material. The open-ended loop portion is adapted to forshorten the overall needle length, but still permits the entire needle length to carry material. The angle subtended by the planes is preferably selectable over a range of ± 52°.

BRIEF DESCRIPTION OF THE DRAWING

The needle according to my invention will be better understood by means of the accompanying drawing, in which.

DESCRIPTION OF THE PREFERRED EMBODIMENT

Figure 1:
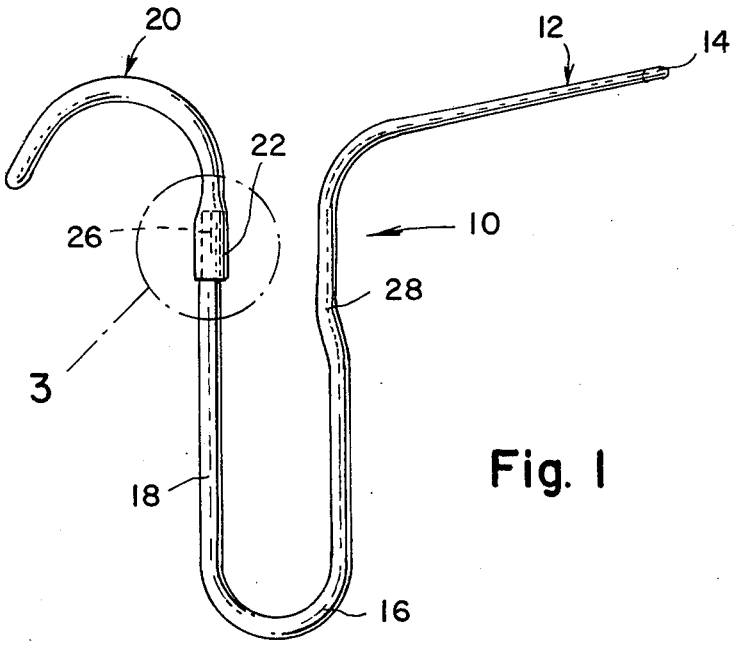
FIG. 1 shows an elevation of the needle according to my invention.
Figure 2:
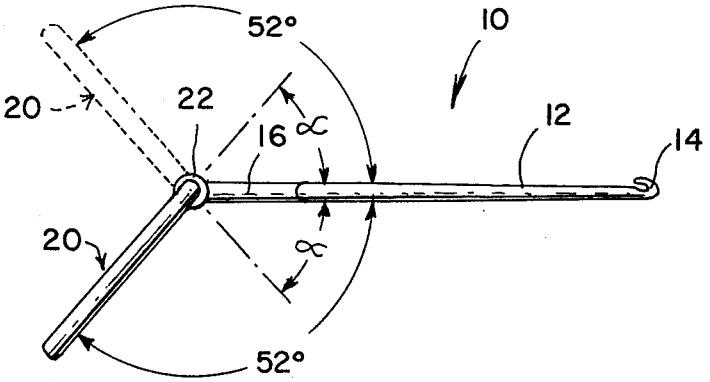
FIG. 2 shows a plan view of the needle.
Figure 3:
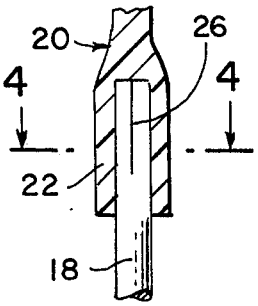
FIG. 3 shows a detail of FIG. 1 in part cross-section.

I provide a rug needle 10 which has an elongated shank and holding portion with a first straight portion 12, which is formed with a hook 14 on one end of the shank and holding portion, the other end of the shank and holding portion is formed as an open-ended looped handgripping portion 16, which terminates in a second straight portion 18. The entire shank and holding portion substantially defines a first plane.

A longitudinal saddle portion 20 designed to rest on the index finger of an operator includes a third substantially straight portion 22 and substantially defines a second plane. The third portion 22 is variably attachable to the second straight portion so that the planes can subtend an angle with one another, which is selectable over a range of ± 52° approximately; the saddle portion 20 is disposed at a higher elevation than the shank and holding portion 12, when the latter is attached to the former; the saddle portion 20 has a length smaller than the length of the shank and holding portion 12.

Figure 4:
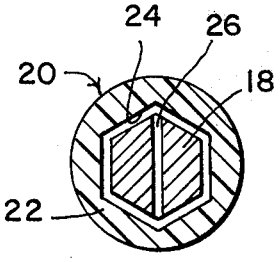
FIG. 4 shows a cross-section of FIG. 3 along the line 4—4.

The end of the second straight portion 18 has a polygonal cross-section, e.g. in the shape of a hexagon, as can be best seen from FIG. 4, and the third straight portion 22 is formed with a polygonally-shaped recess 24 so that the straight portions 18 and 22 can be fittingly attached to one another. The end of the second straight portion 18 is formed with a longitudinal slot 26 so as to be resiliently compressible when attached to the third straight portion 22. It is, of course, also possible to shape the needle so that the second straight portion 18 fits over the third straight portion 22, in which case the latter is formed with a longitudinal slot. It is preferable if at least the portion 22 of the saddle portion 20 is synthetic plastic material.

It is preferable if the open-ended looped portion 16 is positionable in the palm of an operator's hand. A part 28 disposed opposite the straight portion 18 is then bowed forwardly, so that it can be engaged by the operator's fingers and thus form a natural grip.

The saddle portion 20 is curved; the first and second planes intersect one another substantially at the portions 18 and 22. The hook 14 substantially defines a third plane which lies substantially at right angles to the second plane.

The hook 14 is designed to pierce material so that the material can be moved onto the needle. The entire length of the needle is then free and adapted to receive the material. The open-ended loop portion 16 is additionally adapted to forshorten the overall needle length, while still permitting the entire needle length to carry the material, and the hook 14 is disposed opposite the saddle portion 20.

Although the invention has been described with respect to a preferred form thereof, it is to be understood that it is not to be so limited since changes can be made therein which are within the full intended scope of this invention as defined by the appended claims.

What is claimed is:

1. A needle comprising:

a first straight portion formed from a single length of rod or wire, substantially defining a first plane and having two ends, one of said ends being formed with a hook, an open-ended looped handgripping portion integral with said first straight portion and terminating in a second straight portion having said second end, a longitudinal saddle portion restable on the index finger of an operator terminating in a third substantially straight portion and substantially defining a second plane, and means for variably attaching said third straight portion to said second straight portion for said planes to subtend a selectable angle with one another, said saddle portion being disposed at a higher elevation than said first straight portion, attached thereto and having a length smaller than the length of said first straight portion.

2. A needle according to claim 1 wherein one of said second and third straight portions has a polygonal cross-section and the other of said second and third straight portions is formed with a polygonally-shaped recess for said one of said second and third straight portions to be fittingly attachable to said other of said second and third straight portions.

3. A needle according to claim 2 wherein one of said second and third straight portions has an end formed with a longitudinal slot, the latter being resiliently compressible upon attachment of said other of said second and third straight portions thereto.

4. A needle according to claim 1, wherein at least said third straight portion is synthetic plastic material.

5. A needle according to claim 1 wherein said open-ended looped portion is positionable in the palm of the operator's hand, and wherein a part thereof disposed opposite said third straight portion is bowed forwardly to be engageable by the operator's fingers and form a natural grip.

6. A needle according to claim 1 wherein said saddle portion is curved, wherein said planes intersect each other substantially along said third and second portions, and wherein said hook defines substantially a third plane lying substantially at right angles to said second plane.

7. A needle according to claim 1 wherein said hook is disposed opposite said saddle portion and is designed to pierce material so that the material is movable onto the needle, the entire length of the needle being free and adapted to receive material, said open-ended loop portion being adapted to forshorten the overall needle length while still permitting the entire needle length to carry material.

8. A needle according to claim 1, wherein said angle is selectable over a range of approximately plus and minus 52 degrees.

* * * * *